US012098333B2

(12) United States Patent
Weiss et al.

(10) Patent No.: US 12,098,333 B2
(45) Date of Patent: Sep. 24, 2024

(54) PROCESS FOR THE PREPARATION OF OLEFINS, INVOLVING DE-ASPHALTING, HYDROCONVERSION, HYDROCRACKING AND STEAM CRACKING

(71) Applicant: IFP Energies nouvelles, Rueil-Malmaison (FR)

(72) Inventors: Wilfried Weiss, Rueil-Malmaison (FR); Isabelle Merdrignac, Rueil-Malmaison (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 17/766,794

(22) PCT Filed: Oct. 2, 2020

(86) PCT No.: PCT/EP2020/077707
§ 371 (c)(1),
(2) Date: Apr. 6, 2022

(87) PCT Pub. No.: WO2021/069330
PCT Pub. Date: Apr. 15, 2021

(65) Prior Publication Data

US 2024/0067891 A1 Feb. 29, 2024

(30) Foreign Application Priority Data

Oct. 7, 2019 (FR) ..... 1911094

(51) Int. Cl.
*C10G 67/16* (2006.01)
*C10G 67/04* (2006.01)
*C10G 67/14* (2006.01)

(52) U.S. Cl.
CPC ..... *C10G 67/16* (2013.01); *C10G 67/0454* (2013.01); *C10G 67/14* (2013.01);
(Continued)

(58) Field of Classification Search
CPC ..... C10G 67/0409; C10G 7/06; C10G 9/36; C10G 21/003; C10G 21/14; C10G 45/16;
(Continued)

(56) References Cited

U.S. PATENT DOCUMENTS 9,243,194 B2 1/2016 Morel et al.
9,856,425 B2 1/2018 Ward et al.
(Continued)

FOREIGN PATENT DOCUMENTS

CN 1116231 A 2/1996
EP 3260520 A1 12/2017
(Continued)

OTHER PUBLICATIONS

English Translation of International Search Report for PCT/EP2020/077707 dated Nov. 24, 2020.

*Primary Examiner* — Randy Boyer
*Assistant Examiner* — Juan C Valencia
(74) *Attorney, Agent, or Firm* — MILLEN, WHITE, ZELANO & BRANIGAN, P.C.; Csaba Henter

(57) ABSTRACT

The present invention relates to a process for producing olefins from a hydrocarbon feedstock 11 having a sulfur content of at least 0.1 weight %, an initial boiling point of at least 180° C. and a final boiling point of at least 600° C.

14 Claims, 1 Drawing Sheet

(52) U.S. Cl.
CPC ..... *C10G 2300/1077* (2013.01); *C10G 2300/202* (2013.01); *C10G 2300/205* (2013.01); *C10G 2300/206* (2013.01); *C10G 2300/301* (2013.01); *C10G 2300/4006* (2013.01); *C10G 2300/4012* (2013.01); *C10G 2300/44* (2013.01); *C10G 2400/20* (2013.01)

(58) Field of Classification Search
CPC ..... C10G 47/00; C10G 2300/202; C10G 2300/301; C10G 2300/4006; C10G 2300/4012; C10G 2300/4018; C10G 2300/44; C10G 2400/20; C10G 45/02; C10G 65/12; C10G 67/0454; C10G 69/06; C10G 67/16; C10G 7/14; C10G 2300/1077; C10G 2300/205; C10G 2300/206; C10G 11/18; C10G 2400/30; C10G 21/02; C10G 51/026; C10G 55/06; C10G 69/00; C10G 21/16; C10G 21/20; C10G 49/16; C10G 2300/10; C07C 4/02
See application file for complete search history.

(56) References Cited

U.S. PATENT DOCUMENTS

| | | | | |
|---|---|---|---|---|
| 2004/0163996 | A1* | 8/2004 | Colyar ..... | C10G 65/18 208/108 |
| 2013/0081976 | A1 | 4/2013 | Heraud et al. | |
| 2016/0369190 | A1 | 12/2016 | Ward et al. | |
| 2017/0369796 | A1* | 12/2017 | Le Coz ..... | C10G 69/04 |

FOREIGN PATENT DOCUMENTS

| | | | |
|---|---|---|---|
| FR | 2958656 | A1 | 10/2011 |
| FR | 2958656 | B1 | 10/2011 |
| WO | 2015000846 | A1 | 1/2015 |

* cited by examiner

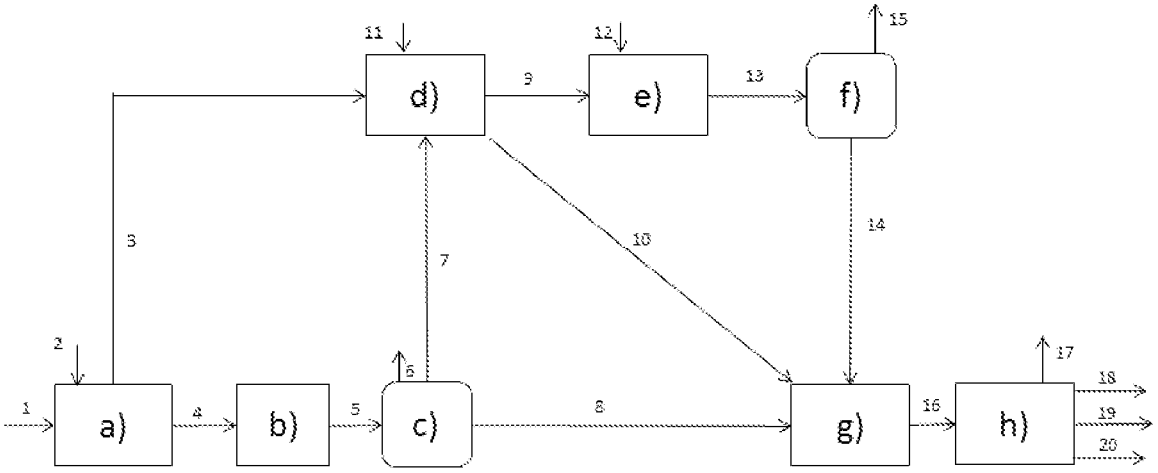
a)
b)
c)
d)
e)
f)
g)
h)
1
2
3
4
5
6
7
8
9
10
11
12
13
14
15
16
17
18
19
20

PROCESS FOR THE PREPARATION OF OLEFINS, INVOLVING DE-ASPHALTING, HYDROCONVERSION, HYDROCRACKING AND STEAM CRACKING

TECHNICAL FIELD

The present invention relates to a process for producing olefins from heavy hydrocarbon fractions whose constituents include sulfur impurities, metals and asphaltenes.

PRIOR ART

The improvement in engines and the progressive electrification of a part of the vehicle stock have driven a change in the demand for petroleum products, with a tendency to reduce the growth in the demand for motor fuels. Conversely, the growth in the demand for primary petrochemicals and particularly for olefins is more sustained. Ethylene and propylene, for example, are olefins which are highly sought after, since they are essential intermediates for numerous petrochemical products such as polyethylene or polypropylene. There is therefore an advantage in further integrating the existing refining sites and petrochemical sites, in remodelling the refining sites so as to produce, at least partly, primary petrochemicals, or in designing new integrated refining-petrochemistry systems, or else in designing sites where the majority or all of the crude is converted into primary petrochemicals.

The main process enabling the conversion of heavy hydrocarbon fractions into olefins in high yield is that of steam cracking. The production of the desired olefins is accompanied by co-products, notably aromatic compounds and pyrolysis oil, which require purification steps. Moreover, the selectivity for desired olefins is heavily dependent on the quality of the feedstocks introduced into the steam cracking step. There is therefore an advantage in identifying new processes enabling the production of olefins from heavy hydrocarbon fractions in a way which is more efficient, profitable, and independent of the heavy hydrocarbon fraction treated.

Advantageously, the process of the invention allows optimization of the properties of the fractions to be introduced into the steam cracking step, and hence maximization of the yields of olefins of interest during the steam cracking step.

In the processes for treating heavy hydrocarbon fractions, the hydrotreating of residue in a fixed bed allows some of the contaminants of the feedstock to be removed, notably the metals, sulfur and asphaltenes.

It is also known practice to perform deasphalting operations. Deasphalting enables the separation of an asphaltene-rich asphalt fraction, referred to as pitch, from a deasphalted oil fraction, referred to as DAO for "DeAsphalted Oil", with a greatly reduced asphaltene content, thereby facilitating its profitable exploitation by catalytic cracking or hydrocracking.

The conversion products and more particularly the heavy cuts obtained from conversion processes, such as deasphalted oils and vacuum distillates, are difficult to treat directly in a steam cracking step. The presence of high levels of naphthenic and aromatic compounds leads to a sharp drop in the yields of olefins of interest, a rise in the yield of pyrolysis oil, and increased coking of the tubes of the steam cracking furnaces, which is detrimental to operability. It is therefore necessary to enhance the operability of the steam cracking step in order to produce olefins with a good yield.

The present invention aims to overcome the problems set out above, and notably to provide a process which allows flexible production of olefins and optimized production from heavy hydrocarbon feedstocks, so as to enhance the profitability of the olefin production process.

Accordingly, the Applicant has developed a new process for producing olefins, comprising a deasphalting step for producing a DAO fraction and an asphalt fraction, a step of hydroconversion of the asphalt fraction in an ebullated bed, a fixed-bed hydrocracking step, an extraction step for producing a raffinate and a fraction rich in aromatics, and a step of steam cracking of said raffinate.

The process of the present invention features the following advantages:

- production of olefins from heavy fractions in a good yield,
- a reduction in the cost of olefin production,
- flexibility of the process, enabling the treatment of all heavy hydrocarbon fractions irrespective of their origin,
- the sequencing of a deasphalting step and a step of hydroconversion of the asphalt fraction, enabling thorough conversion of the residual fraction and notably of the asphaltenes,
- the limitation of coking during said steam cracking step.

SUMMARY OF THE INVENTION

The subject of the present invention relates to a process for producing olefins from a hydrocarbon feedstock 1 with a sulfur content of at least 0.1 weight %, an initial boiling point of at least 180° C. and a final boiling point of at least 600° C., said process comprising the following steps:

a) a deasphalting step a) by extraction of said heavy hydrocarbon feedstock 1 using a solvent 2 or a mixture of solvents, enabling the production on the one hand of an asphalt-comprising fraction 4 and on the other hand of a deasphalted oil fraction 3, b) a step b) of hydroconversion performed in an ebullated-bed reactor, in which the asphalt fraction 4 is contacted, in the presence of hydrogen, with a hydroconversion catalyst, said step enabling the production of an effluent 5, c) a step c) of separation of the effluent 5 obtained from the hydroconversion step b) into a gaseous fraction 6, a fraction 7 comprising compounds with a boiling point of between 180 and 540° C., and a fraction 8 comprising compounds with a boiling point of less than 180° C., d) a step d) of extraction of the aromatics from at least part of the deasphalted oil fraction 3 obtained from the deasphalting step a), and from at least part of the fraction 7 obtained from the separation step c), enabling the production of an extract fraction 9 and of a raffinate fraction 10, e) a step e) of fixed-bed hydrocracking of at least part of the extract fraction 9 obtained from the extraction step d) in the presence of hydrogen 12 and of a hydrocracking catalyst, enabling the production of an effluent 13, f) a step f) of separation of the effluent 13 obtained from the fixed-bed hydrocracking step e) into at least one gaseous fraction 15 and at least one liquid fraction 14 comprising compounds with a boiling point of less than or equal to 350° C., g) a step g) of steam cracking of the raffinate fraction 10 obtained from the extraction step d), of the fraction 8 obtained from the separation step c) and of the liquid fraction 14 obtained from the separation step f), enabling the production of an effluent 16, h) a step h) of separation of the effluent 16 obtained from the steam cracking step g), enabling the production of at least one hydrogen-comprising fraction 17, of an ethylene-comprising fraction 18, of a propylene-comprising fraction 19 and of a fraction 20 comprising pyrolysis oil.

In one preferred embodiment, the deasphalting step a) is performed under specific conditions enabling the production on the one hand of a quality DAO fraction 3 preferably with a low asphaltene content, and on the other hand of an asphalt-comprising fraction 4 with a softening point of less than 120° C.

In one preferred embodiment, the solvent 2 used in step a) is an apolar solvent composed of at least 80% by volume of saturated hydrocarbon(s) comprising a carbon number of between 3 and 5.

In one preferred embodiment, the separation step c) comprises a vacuum distillation enabling the production of a vacuum distillate fraction and of a vacuum residue fraction. Preferably, the separation step c) comprises, upstream of the vacuum distillation, an atmospheric distillation enabling the production of at least one atmospheric distillate fraction and at least one atmospheric residue fraction, said atmospheric residue fraction being sent into said vacuum distillation, enabling the production of at least one vacuum distillate fraction and at least one vacuum residue fraction.

In one preferred embodiment, the polar solvent employed in the aromatics extraction step d) is selected from furfural, N-methyl-2-pyrrolidone (NMP), sulfolane, dimethylformamide (DMF), dimethyl sulfoxide (DMSO) and phenol, or a mixture of these solvents.

In one preferred embodiment, the hydrocracking step e) is implemented at a temperature of between 340 and 480° C. and at an absolute pressure of between 5 and 25 MPa.

In one preferred embodiment, the hydrocracking step e) is performed so as to produce a yield of liquid compounds with a boiling point of less than 180° C. of more than 50 weight % of the feedstock entering the hydrocracking step e).

In one preferred embodiment, the separation step f) comprises at least one atmospheric distillation enabling the production of at least one liquid fraction 14 comprising compounds with a boiling point of less than 350° C. and a liquid fraction comprising vacuum distillate comprising compounds with a boiling point of greater than 350° C. Preferably, the liquid fraction 14 and the fraction comprising vacuum distillate are sent into the steam cracking step g).

In one preferred embodiment, part of a fraction 8 comprising compounds with a boiling point of less than 180° C., obtained from the separation step c), is introduced into the steam cracking step g).

In one preferred embodiment, the steam cracking step g) is performed in at least one pyrolysis furnace at a temperature of between 700 and 900° C., under a pressure of between 0.05 and 0.3 MPa, for a residence time of less than or equal to 1.0 second.

In one preferred embodiment, the cuts rich in saturated compounds which are obtained from the light gases or from the pyrolysis gasoline obtained from the separation step h) are recycled into the steam cracking step g).

In one preferred embodiment, the pyrolysis oil fraction 21 is subjected to an additional separation step so as to produce a light pyrolysis oil, comprising compounds with a boiling point of less than 350° C., and a heavy pyrolysis oil, comprising compounds with a boiling point of greater than 350° C., said light pyrolysis oil is injected upstream of the hydrocracking step e), and said heavy pyrolysis oil is injected upstream of the hydroconversion step b) and/or of the deasphalting step a).

BRIEF DESCRIPTION OF THE DRAWINGS

FIG. 1 represents a sequence of the steps in the process according to the invention.

DESCRIPTION OF THE EMBODIMENTS

It is specified that, throughout this description, the expression "between . . . and . . . ", "less than . . . " or "greater than" should be understood as including the limits stated.

For the purposes of the present invention, the various embodiments presented may be used alone or in combination with each other, without any limit to the combinations.

In the remainder of the description, reference is made to FIG. 1, which illustrates an example of implementation of the process for producing olefins from heavy hydrocarbon feedstocks according to the invention. The indication of the elements referenced in FIG. 1 in the remainder of the description enables better understanding of the invention, without said invention being limited to the particular example illustrated in FIG. 1.

As represented in FIG. 1, the process according to the invention comprises the following steps:

a step a) of deasphalting of the heavy hydrocarbon feedstock 1 or the mixture of feedstocks, with a solvent or a combination of solvents 2, enabling the production of at least one fraction comprising deasphalted oil (DAO) 3, and an asphalt-comprising fraction 4, a step b) of hydroconversion of the asphalt fraction 4 in an ebullated bed, in the presence of a hydrogen-rich gas, in at least one ebullated-bed reactor including a hydroconversion catalyst, a step c) of separation of the effluent 5 obtained from the hydroconversion step b), enabling the production of at least one hydrogen-comprising gaseous fraction 6, a liquid fraction 7 comprising compounds with a boiling point of between 180 and 540° C., and at least one fraction 8 comprising compounds with a boiling point of less than 180° C., a step d) of extraction of at least part of the fraction 3 comprising deasphalted oil (DAO) obtained from the deasphalting step a) and at least part of the fraction 7 obtained from the separation step c), with a solvent or a combination of solvents 11, enabling the production of at least one fraction 10 rich in saturated compounds (raffinate), and a fraction 9 rich in aromatic compounds (extract), a step e) of hydrocracking in the presence of a hydrogen-rich gas 12 and of at least part of the aromatics-rich fraction 9 obtained from the extraction step d), performed in at least one fixed-bed reactor including a hydrocracking catalyst, a step f) of separation of the effluent 13 obtained from the hydrocracking step e), enabling the production of at least one hydrogen-comprising gaseous fraction 15, and a liquid fraction 14 comprising compounds with a boiling point of less than 350° C., a step g) of steam cracking of the raffinate fraction 10 obtained from the extraction step d), of the fraction 8 obtained from the separation step c) and of the liquid fraction 14 containing compounds with a boiling point of less than 350° C., obtained from the separation step f), a step h) of separation of the effluent 16 obtained from the steam cracking step g), enabling the recovery of at least one hydrogen-comprising fraction 17, an ethylene-comprising fraction 18, a propylene-comprising fraction 19 and a fraction 20 comprising pyrolysis oil.

The above description of FIG. 1 is an example of implementation of the invention, which does not in any way limit the invention. Only the main steps are represented in said FIGURES, but it is understood that all the equipment required for operation is present (drums, pumps, exchangers, furnaces, columns, etc.). Only the main streams containing the hydrocarbons are represented, but it is understood that hydrogen-rich gas streams (top-up or recycle) can be injected at the inlet of each catalytic reactor or bed or between two catalytic reactors or beds. Means well known to those skilled in the art for purifying and recycling hydrogen are also used. The hydrogen produced during the steam cracking step is advantageously used to top up the hydroconversion step b) and/or the hydrocracking step d).

According to a variant not shown, at least part of the pyrolysis oil fraction 20 obtained from the separation step h) may be injected upstream of the deasphalting step a) and/or of the hydroconversion step b). Advantageously, this variant enables the partial elimination of the asphaltenes contained in the pyrolysis oil and hence the maximization of olefin production.

According to a variant not shown, the pyrolysis oil fraction 20 obtained from the separation step h) may be separated into at least two fractions, for example into a light pyrolysis oil fraction which is sent at least partly to the hydrocracking step e), and a heavy pyrolysis oil fraction which is sent at least partly to the hydroconversion step b) and/or the deasphalting step a). Advantageously, this variant enables further maximization of olefin production.

According to a variant not shown, step c) separating the effluent 5 obtained from the hydroconversion step b) enables the production, moreover, of an atmospheric distillate fraction comprising compounds with a boiling point of between 180 and 350° C., which may be introduced at least partly into the aromatics extraction step d).

The feedstock treated and the various steps of the process of the invention are now described in greater detail below.

The Feedstock

The heavy hydrocarbon feedstock 1 treated in the process of the invention is advantageously a hydrocarbon feedstock containing asphaltenes, and in particular having a C7 asphaltene content of at least 1.0 weight %, preferably of at least 2.0 weight %, relative to the weight of the feedstock.

The feedstock 1 has an initial boiling point of at least 180° C., preferably of at least 350° C. and more preferably of at least 540° C., and a final boiling point of at least 600° C.

The hydrocarbon feedstock 1 according to the invention may be selected from atmospheric residues, vacuum residues obtained from direct distillation, crude oils, topped crude oils, bituminous sands or derivatives thereof, bituminous schists or derivatives thereof, and source rock oils or derivatives thereof, taken alone or as a mixture. In the present invention, the feedstocks treated are preferably atmospheric residues or vacuum residues, or mixtures of these residues, and more preferentially vacuum residues.

The heavy hydrocarbon feedstock treated in the process may contain, inter alia, sulfur impurities. The sulfur content may be at least 0.1 weight %, at least 0.5 weight %, preferably at least 1.0 weight %, more preferably at least 2.0 weight %, relative to the weight of the feedstock.

The heavy hydrocarbon feedstock treated in the process may contain, inter alia, metals. The nickel and vanadium content may be at least 20 ppm, preferably at least 50 ppm, relative to the weight of the feedstock.

The heavy hydrocarbon feedstock treated in the process may contain, inter alia, Conradson carbon. The Conradson carbon content may be at least 2.0 weight %, preferably at least 5.0 weight %, relative to the weight of the feedstock.

These feedstocks may advantageously be used as they are. Alternatively, said feedstocks may be blended with at least one co-feedstock.

Preferably a plurality of co-feedstocks may be used in various steps of the process of the invention so as to modify the viscosity of the feedstock introduced at each of the steps. A co-feedstock may be introduced upstream of at least one reactor of the hydroconversion step b).

This co-feedstock may be a hydrocarbon fraction or a mixture of lighter hydrocarbon fractions, which may preferably be selected from products obtained from a fluid-bed catalytic cracking (FCC or Fluid Catalytic Cracking) process, in particular a light cut (LCO or Light Cycle Oil), a heavy cut (HCO or Heavy Cycle Oil), a decanted oil, an FCC residue. This co-feedstock may also be an atmospheric diesel oil fraction or a vacuum diesel oil fraction, obtained by atmospheric or vacuum distillation of a crude oil or of an effluent from a conversion process such as coking or visbreaking, or obtained from separation steps c) and/or f). This co-feedstock does not represent more than 20 weight % of the heavy hydrocarbon feedstock 1.

Deasphalting Step a)

In accordance with the invention, the process comprises a step a) of deasphalting by liquid-liquid extraction of the heavy hydrocarbon feedstock 1 or of the mixture of feedstocks c). Said step a) is implemented by liquid-liquid extraction using a solvent or a mixture of solvents 2, enabling the production on the one hand of an asphalt-comprising fraction 4 and on the other hand of a deasphalted oil (DAO) fraction 3.

The deasphalting step a) is performed preferably under specific conditions enabling the production on the one hand of a quality DAO fraction 3, preferably with a low asphaltenes content, and on the other hand of an asphalt-comprising fraction 4 which is relatively soft, i.e. having a softening point of less than 120° C., preferably less than 100° C.

The deasphalting step a) is preferably performed in a single step by means of an apolar solvent or a mixture of apolar solvents.

Step a) may be performed in an extraction column or extractor, or in a mixer-settler. Step a) is preferably performed in an extraction column containing liquid-liquid contactors (packing elements and/or plates, etc.) placed in one or more zones. Preferably, the solvent or the solvent mixture 2 is introduced into the extraction column at two different levels. Preferably, the deasphalting feedstock is introduced into an extraction column at only one introduction level, generally as a mixture with at least one portion of the solvent or of the solvent mixture 2 and generally below a first zone of liquid-liquid contactors. Preferably, the other part of the solvent or solvent mixture 2 is injected lower than the deasphalting feedstock, generally below a second zone of liquid-liquid contactors, the deasphalting feedstock being injected above this second zone of contactors.

Step a) is performed under subcritical conditions, in other words below the critical point, for said solvent or solvent mixture 2. Step a) is performed at a temperature advantageously between 50 and 350° C., preferably between 80 and 320° C., more preferably between 120 and 310° C. and even more preferably between 150 and 300° C., and at a pressure advantageously between 0.1 and 6 MPa, preferably between 1 and 6 MPa and more preferably between 2 and 5 MPa.

The volume ratio of the solvent or solvent mixture 2 to the feedstock volume 1 is generally between 1/1 and 12/1, preferably between 2/1 to 9/1, expressed in litres per litre. This ratio includes all of the solvent or mixture of solvents, which may be divided into several injection points.

The apolar solvent used is preferably a solvent composed of saturated hydrocarbon(s) comprising a carbon number of greater than or equal to 3, preferably of between 3 and 5. These solvents may for example be propane, butane or pentane. These solvents are utilized pure or as a mixture.

The solvent 2 used in step a) is preferably an apolar solvent composed of at least 80% by volume of saturated hydrocarbon(s) comprising a carbon number of between 3 and 5, in order to maximize the quality of the asphalt-comprising fraction 4 to be treated in the hydroconversion step b).

The selection of the temperature and pressure conditions for the extraction, combined with the selection of the type of solvents 2 in the deasphalting step a), make it possible to adjust the extraction performance. Step a) may make it possible, by virtue of these specific deasphalting conditions, to precipitate, from the asphalt-comprising fraction 4, an adjusted amount of polar structures of heavy resin and asphaltene type, thereby making it possible to obtain an asphalt-comprising fraction 4 in an improved yield, generally more than 40%, or even more than 50% relative to the amount of compounds with a boiling point of greater than 540° C. at the entry to the deasphalting step a). The resulting DAO fraction 3 comprises less than 1,000 ppm of C7 asphaltenes, generally less than 500 ppm of C7 asphaltenes, or even less than 300 ppm of C7 asphaltenes.

A fraction which comprises the DAO fraction 3 and a portion of the solvent or solvent mixture is recovered at the top of the extraction column or of the mixer-settler, preferably above the highest-positioned liquid-liquid contactor zone.

A fraction 4 which comprises the asphalt and some of the solvent or mixture of solvents is recovered at the bottom of the extraction column or of the mixer-settler, preferably below the lowest-positioned contactor zone.

The solvent or solvent mixture 2 may consist of a top-up and/or of a portion recycled during separation steps. These top-ups advantageously enable the solvent losses in the asphalt-comprising fraction 4 and/or in the DAO fraction 3, owing to the separation steps, to be compensated.

The deasphalting step a) comprises an integrated substep of separation of the DAO-comprising fraction 3 and of the solvent or solvent mixture. The solvent or solvent mixture recovered can be recycled into the deasphalting step a). This integrated separation substep making it possible to separate the DAO 3 and the solvent or solvent mixture can use all the required equipment known to those skilled in the art (separating drums, distillation or stripping columns, heat exchangers, furnaces, pumps, compressors, etc.).

At least some, and preferably all, of the DAO fraction 3 is sent to the aromatics extraction step c).

At least a portion, and preferably all, of the asphalt-comprising fraction 4 is sent to the ebullated-bed hydroconversion step b).

Ebullated-Bed Hydroconversion Step b)

In accordance with the invention, an ebullated-bed hydroconversion step b) is performed in an ebullated-bed reactor, in which the asphalt-comprising fraction 4 obtained from the deasphalting step a) is contacted, in the presence of hydrogen, with a hydroconversion catalyst. Advantageously, the asphalt-comprising fraction 4 is introduced into step b) in the presence of a co-feedstock.

The term "hydroconversion" refers to all of the reactions performed for reducing the size of the molecules, mainly by cleaving carbon-carbon bonds, by the action of hydrogen in the presence of a catalyst. Hydrotreating and hydrocracking reactions notably take place during the hydroconversion step.

Preferably, the hydroconversion step b) comprises one or more three-phase reactors with upflow of liquid and of gas containing at least one hydroconversion catalyst, the ebullated-bed reactors, which may be in series and/or in parallel, typically functioning with the aid of the technology and under the conditions of the H-Oil™ process as described, for example, in patents U.S. Pat. Nos. 4,521,295, 4,495,060, 4,457,831 or U.S. Pat. No. 4,354,852, or in the article AIChE, Mar. 19-23, 1995, Houston, Texas, paper number 46d, "Second generation ebullated bed technology", or in chapter 3.5 "Hydroprocessing and Hydroconversion of Residue Fractions" from the book "Catalysis by Transition Metal Sulphides", published by Editions Technip in 2013. Each reactor advantageously includes a recirculation pump which makes it possible to maintain the catalyst in an ebullated bed by continuous recycling of at least a portion of a liquid fraction advantageously withdrawn at the top of the reactor and reinjected at the bottom of the reactor.

The hydroconversion step b) is performed under conditions enabling the production of a liquid effluent with a reduced content of sulfur, Conradson carbon, metals and nitrogen.

Advantageously, step b) is preferably performed under an absolute pressure of between 2 MPa and 38 MPa, more preferentially between 5 MPa and 25 MPa and even more preferably between 6 MPa and 20 MPa, at a temperature of between 300° C. and 550° C., more preferentially of between 350° C. and 500° C. and preferably of between 370° C. and 450° C. The hourly space velocity (HSV) relative to the volume of each three-phase reactor is preferably between 0.05 $h^{-1}$ and 10 $h^{-1}$. According to one preferred embodiment, the HSV is between 0.1 $h^{-1}$ and 10 $h^{-1}$, more preferentially between 0.1 $h^{-1}$ and 5.0 $h^{-1}$ and more preferably still between 0.15 $h^{-1}$ and 2.0 $h^{-1}$. According to another embodiment, the HSV is between 0.05 $h^{-1}$ and 0.09 $h^{-1}$. The amount of hydrogen mixed with the feedstock is preferably between 50 and 5000 normal cubic metres ($Nm^3$) per cubic metre ($m^3$) of liquid feedstock, preferably between 100 and 2000 $Nm^3/m^3$ and very preferably between 200 and 1000 $Nm^3/m^3$.

The hydroconversion catalyst used in the hydroconversion step b) of the process according to the invention may contain one or more elements from groups 4 to 12 of the Periodic Table of the Elements, which may or may not be deposited on a support. Use may advantageously be made of a catalyst comprising a support, preferably an amorphous support, such as silica, alumina, silica/alumina, titanium dioxide or combinations of these structures, and very preferably alumina.

The catalyst may contain at least one non-noble metal from group VIII chosen from nickel and cobalt, preferably nickel, said element from group VIII preferably being used in combination with at least one metal from group VIB chosen from molybdenum and tungsten; preferably, the metal from group VIB is molybdenum.

In the present description, the groups of chemical elements are given according to the CAS classification (CRC Handbook of Chemistry and Physics, published by CRC Press, Editor in Chief D. R. Lide, 81st edition, 2000-2001). For example, group VIII according to the CAS classification corresponds to the metals of columns 8, 9 and 10 according to the new IUPAC classification.

Advantageously, the hydroconversion catalyst used in the hydroconversion step b) comprises an alumina support and at least one metal from group VIII chosen from nickel and cobalt, preferably nickel, and at least one metal from group VIB chosen from molybdenum and tungsten, preferably molybdenum. Preferably, the hydroconversion catalyst comprises nickel as element from group VIII and molybdenum as element from group VIB.

The content of non-noble metal from group VIII, in particular of nickel, is advantageously between 0.5% to 10.0%, expressed as weight of metal oxide (in particular of NiO), and preferably between 1.0% to 6.0% by weight, and the content of metal from group VIB, in particular of molybdenum, is advantageously between 1.0% to 30%, expressed as weight of metal oxide (in particular of molybdenum trioxide $MoO_3$), and preferably between 4% to 20% by weight. The contents of metals are expressed as weight percentage of metal oxide relative to the weight of the catalyst.

This catalyst is advantageously used in the form of extrudates or of beads. The beads have, for example, a diameter of between 0.4 mm and 4.0 mm. The extrudates have, for example, a cylindrical form with a diameter of between 0.5 and 4.0 mm and a length of between 1.0 and 5.0 mm. The extrudates may also be objects of a different shape such as trilobes, regular or irregular tetralobes, or other multilobes. Catalysts in other forms may also be used, for example in the form of pellets.

The size of these various forms of catalysts may be characterized by means of the equivalent diameter. The equivalent diameter is defined as six times the ratio between the volume of the particle and the external surface area of the particle. The catalyst used in the form of extrudates, beads or other forms thus has an equivalent diameter of between 0.4 mm and 4.4 mm. These catalysts are well known to those skilled in the art.

In one of the embodiments of the process according to the invention, a different hydroconversion catalyst is used in each reactor of this initial hydroconversion step (a1), the catalyst proposed for each reactor being suited to the feedstock sent to this reactor.

In one of the embodiments of the process according to the invention, several types of catalysts are used in each reactor.

In one of the embodiments of the process according to the invention, each reactor contains one or more catalysts that are suitable for ebullated-bed operation.

As is known, and described, for example, in patent FR 3 033 797, when it is spent, the hydroconversion catalyst may be partly replaced with fresh catalyst, and/or with spent catalyst which has higher catalytic activity than the spent catalyst to be replaced, and/or with regenerated catalyst, and/or with rejuvenated catalyst (catalyst obtained from a rejuvenation zone in which the majority of the deposited metals are removed, before sending the spent rejuvenated catalyst to a regeneration zone in which the carbon and sulfur it contains are removed, thus increasing the activity of the catalyst), by withdrawing the spent catalyst preferably at the bottom of the reactor, and by introducing replacement catalyst either at the top or at the bottom of the reactor. This replacement of spent catalyst is preferably performed at regular time intervals, and preferably portionwise or virtually continuously. The replacement of spent catalyst may be totally or partly done with spent and/or regenerated and/or rejuvenated catalyst obtained from the same reactor and/or from another reactor of any hydroconversion step. The catalyst may be added with the metals in the form of metal oxides, with the metals in the form of metal sulfides, or after preconditioning. For each reactor, the degree of replacement of the spent hydroconversion catalyst with fresh catalyst is advantageously between 0.01 kg and 10 kg per cubic metre of feedstock treated and preferably between 0.1 kg and 3 kg per cubic metre of feedstock treated. This withdrawing and this replacement are performed using devices which advantageously permit continuous functioning of this hydroconversion step.

As regards the at least partial replacement with regenerated catalyst, it is possible to send the spent catalyst withdrawn from the reactor to a regeneration zone, in which the carbon and the sulfur which it contains are removed, and then to return this regenerated catalyst to the hydroconversion step. As regards the at least partial replacement with rejuvenated catalyst, it is possible to send the spent catalyst withdrawn from the reactor to a rejuvenation zone, in which most of the metals deposited are removed, before sending the spent and rejuvenated catalyst to a regeneration zone, in which the carbon and the sulfur which it contains are removed, and then to return this regenerated catalyst to the hydroconversion step b).

The hydroconversion step b) is characterized by a degree of conversion of the compounds boiling above 540° C. of greater than 50% by mass, preferably greater than 70% by mass.

The effluent 5 obtained on conclusion of the hydroconversion step b) comprises at least one liquid fraction 7 and a gaseous fraction 6 containing the gases, in particular $H_2$, $H_2S$, $NH_3$, and $C_1$-$C_4$ hydrocarbons (that is to say comprising from 1 to 4 carbon atoms).

Separation Step c)

In accordance with the invention, the process comprises a step c) of separating the effluent 5 obtained from the hydroconversion step b) into at least one gaseous fraction 6, a fraction 7 comprising compounds with a boiling point of between 180 and 540° C., and a fraction 8 comprising compounds with a boiling point of less than 180° C.

The gaseous fraction 6, the fraction 7 and the fraction 8 may be separated from the effluent 5 using separation devices well known to those skilled in the art, in particular using one or more separating drums which may operate at different pressures and temperatures, optionally in combination with a hydrogen or steam stripping means and with one or more distillation columns. After optional cooling, the gaseous fraction 6 is preferably treated in a hydrogen purification means, so as to recover the hydrogen not consumed during the hydroconversion reactions.

The purified hydrogen may then advantageously be recycled into the process according to the invention. The hydrogen may be recycled at the inlet and/or at various locations in the hydroconversion step b) and/or the ebullated-bed hydrocracking step d).

The separation step c) comprises a vacuum distillation, in which at least part of the effluent 5 obtained from step b) may undergo treatments using well-known separation devices, and may then be fractionated by vacuum distillation to give at least one vacuum distillate fraction and at least one vacuum residue fraction. The vacuum distillate fraction comprises vacuum diesel oil fractions, these being compounds with a boiling point of between 350 and 540° C.

The vacuum residue fraction is preferably a liquid hydrocarbon fraction containing at least 80% of compounds with a boiling point of greater than or equal to 540° C.

The separation step c) preferably comprises an atmospheric distillation, upstream of the vacuum distillation, in which the liquid hydrocarbon fraction(s) obtained after separation are fractionated by atmospheric distillation into at least one atmospheric distillate fraction and at least one atmospheric residue fraction, then a vacuum distillation, in which the atmospheric residue fraction obtained after atmospheric distillation is fractionated by vacuum distillation into at least one vacuum distillate fraction and at least one vacuum residue fraction.

Advantageously, the separation step c) further comprises at least one atmospheric distillation upstream of the vacuum distillation, in which at least part of the effluent 5 obtained from step b) is fractionated by atmospheric distillation into at least one fraction 8 comprising compounds with a boiling point of less than 180° C., and a diesel-comprising distillate fraction, in other words comprising compounds having a boiling point of between 180 and 350° C.

Advantageously, the fraction 8 comprising compounds with a boiling point of less than 180° C. is sent at least partly, and preferably in its entirety, to the steam cracking step g). The distillate fraction containing diesel may be at least partly and preferably entirely sent to the extraction step d).

At least part and preferably all of the fraction 7, comprising at least part and preferably all of a vacuum distillate fraction and of a diesel-containing distillate fraction, is sent to the aromatics extraction step d).

Aromatics Extraction Step d)

In accordance with the invention, the process comprises a step d) of extracting the aromatics from at least part of the deasphalted oil (DAO) fraction 3 obtained from the deasphalting step a), and from at least part of the fraction 7 obtained from step c). Said aromatics extraction step d) enables the production of an extract fraction 9 and a raffinate fraction 10.

The fraction 7 obtained from step c) comprises at least part and preferably all of a vacuum distillate fraction comprising compounds with a boiling point of between 350 and 540° C., and at least part and preferably all of a distillate fraction comprising compounds with a boiling point of between 180 and 350° C., obtained from the separation step c).

The objective of the aromatics extraction step d) is to extract at least part of the aromatic compounds and also the resins by liquid-liquid extraction using a polar solvent 11.

The compounds extracted during step d) preferably have a boiling point greater than the boiling point of the solvent, thereby advantageously enabling maximization of the yield in the separation of the solvent from the raffinate after extraction. Moreover, the recovery of the solvent is also more efficient and economical.

The solvent used may be furfural, N-methyl-2-pyrrolidone (NMP), sulfolane, dimethylformamide (DMF), dimethyl sulfoxide (DMSO), phenol, or a mixture of these solvents in equal or different proportions. The solvent is preferably furfural.

The operating conditions are, in general, a ratio of solvent to step d) feedstock of ½ to 6/1, preferably of 1/1 to 4/1, a temperature profile of between the ambient temperature and 150° C., preferably between 50 and 150° C. The pressure is situated between atmospheric pressure and 2.0 MPa, preferably between 0.1 and 1.0 MPa.

The liquid/liquid extraction may generally be performed in a mixer-settler or in an extraction column operating in counter-current mode. The extraction is preferably performed in an extraction column.

The solvent selected has a sufficiently high boiling point to fluidify the feedstock of step d) without being evaporated.

After the solvent has made contact with the effluent introduced in step d), two fractions are obtained at the end of step d): an extract fraction 9, consisting of the portions of the heavy fraction that are insoluble in the solvent (and are highly concentrated in aromatics), and a raffinate fraction 10, which consists of the solvent and the soluble portions of the heavy fraction. The solvent is separated by distillation from the soluble portions and recycled internally to the liquid/liquid extraction process. The separation of the extract and the raffinate and the recovery of the solvent are performed in a separation substep integrated into the aromatics extraction step d).

Fixed-Bed Hydrocracking Step e)

In accordance with the invention, the process comprises a step e) of fixed-bed hydrocracking of at least part of the extraction fraction 9 obtained from the extraction step d), in the presence of a hydrocracking catalyst.

Hydrogen 12 can also be injected upstream of the various catalytic beds making up the hydrocracking reactor(s). In parallel with the hydrocracking reactions desired in this step, any type of hydrotreatment reaction (HDM, HDS, HDN, etc.) also takes place. Hydrocracking reactions resulting in the formation of atmospheric distillates take place with a degree of conversion of the vacuum distillate into atmospheric distillate which is generally greater than 30%, typically between 30% and 50% for mild hydrocracking and greater than 80% for advanced hydrocracking. Specific conditions, in particular temperature conditions, and/or the use of one or more specific catalysts, make it possible to promote the desired hydrocracking reactions.

The hydrocracking step e) according to the invention is performed under hydrocracking conditions. It may advantageously be implemented at a temperature of between 340° C. and 480° C., preferably between 350° C. and 430° C., and under an absolute pressure of between 5 and 25 MPa, preferably between 8 and 20 MPa, more preferably between 10 and 18 MPa. The temperature is usually adjusted according to the desired level of hydrotreating and the intended duration of the treatment. Most often, the space velocity of the hydrocarbon feedstock, commonly referred to as HSV, which is defined as being the volumetric flow rate of the feedstock divided by the total volume of the catalyst, may be within a range from 0.1 to 3.0 $h^{-1}$, preferably from 0.2 to 2.0 $h^{-1}$, and more preferably from 0.25 to 1.0 $h^{-1}$. The amount of hydrogen mixed with the feedstock may be between 100 and 5000 normal cubic metres ($Nm^3$) per cubic metre ($m^3$) of liquid feedstock, preferably between 200 and 2000 $Nm^3/m^3$, and more preferably between 300 and 1500 $Nm^3/m^3$. The hydrocracking step e) can be performed industrially in at least one reactor having a downward liquid flow.

The hydrocracking step e) preferably comprises two catalytic sections in series, with an upstream hydrotreating catalytic section so as to limit the deactivation of the downstream hydrocracking catalytic section. This hydrotreating section aims in particular to significantly reduce the nitrogen content of the feedstock, nitrogen being an inhibitor of the acid function of the bifunctional catalysts of the hydrocracking catalytic section.

The hydrocracking step e) may also comprise a second hydrocracking catalytic section treating at least one heavy cut obtained from the first hydrocracking catalytic section, separated beforehand in a separation step.

The hydrocracking step e) may comprise the recycling of a heavy cut obtained from the first hydrocracking catalytic section, separated beforehand in a separation step.

The catalysts in the hydrocracking step e) that are used may be hydrotreating and hydrocracking catalysts.

The hydrotreating catalysts used may be hydrotreating catalysts consisting of a support of inorganic oxide type (preferably an alumina) and of an active phase comprising chemical elements from group VIII (Ni, Co, etc.) and group VI (Mo, etc.).

The hydrocracking catalysts may advantageously be bifunctional catalysts, having a hydrogenating phase in order to be able to hydrogenate the aromatics and produce the equilibrium between the saturated compounds and the corresponding olefins, and an acid phase enabling promotion of the hydroisomerization and hydrocracking reactions. The acid function is advantageously provided by supports having large surface areas (generally 100 to 800 $m^2 \cdot g^{-1}$) having surface acidity, such as halogenated (in particular chlorinated or fluorinated) aluminas, combinations of boron and aluminium oxides, amorphous silicas/aluminas and zeolites. The hydrogenating function is advantageously contributed either by one or more metals from group VIII of the Periodic Table of the Elements, such as iron, cobalt, nickel, ruthenium, rhodium, palladium, osmium, iridium and platinum, or by a combination of at least one metal from group VIB of the Periodic Table, such as molybdenum and tungsten, and at least one non-noble metal from group VIII (such as nickel and cobalt). Preferably, the bifunctional catalyst used comprises at least one metal chosen from the group formed by the metals of groups VIII and VIB, taken alone or as a mixture, and a support comprising 10% to 90% by weight of a zeolite and 90% to 10% by weight of inorganic oxides. The metal from group VIB that is used is preferably chosen from tungsten and molybdenum, and the metal from group VIII is preferably chosen from nickel and cobalt. According to another preferred variant, monofunctional catalysts and bifunctional catalysts of alumina, amorphous silica-alumina or zeolitic type can be used as a mixture or in successive layers.

Preferably, the catalytic volume used during the second hydrocracking step e) consists of at least 30% of hydrocracking catalysts of bifunctional type.

Optionally, a co-feedstock (not shown) can be injected upstream of any catalytic bed of the hydrocracking section e). This co-feedstock is typically a vacuum distillate resulting from direct distillation or resulting from a conversion process, or a deasphalted oil.

The hydrocracking step e) is preferably operated in "maxi naphtha" mode, meaning that it enables the production of a yield of liquid compounds with a boiling point of less than 180° C. of more than 50% by weight of the feedstock at the entry to the hydrocracking step e).

The effluent 13 obtained from the fixed-bed hydrocracking step e) is sent to a separation step f).

Step f) of Separation of the Fixed-Bed Hydrocracking Effluent

In accordance with the invention, the process further comprises a step f) of separating the effluent 13 obtained from the fixed-bed hydrocracking step e) into at least one gaseous fraction 15 and at least one liquid fraction 14.

Said effluent 13 is advantageously separated in at least one separating drum into at least one gaseous fraction 15 and at least one liquid fraction 14. The step of separating said effluent 13 may be performed by means of any separating devices known to those skilled in the art, such as one or more separating drums, which may operate at different pressures and temperatures, optionally in combination with a hydrogen or steam stripping means and with one or more distillation columns. These separators can, for example, be high-pressure high-temperature (HPHT) separators and/or high-pressure low-temperature (HPLT) separators.

The gaseous fraction 15 obtained at the end of the separation step e) comprises gases, such as $H_2$, $H_2S$, $NH_3$, and C1-C4 hydrocarbons (such as methane, ethane, propane and butane). Advantageously, the hydrogen contained in the gaseous fraction 15 is purified and recycled into either of the ebullated-bed hydroconversion step b) and/or fixed-bed hydrocracking step e). In one particular embodiment, the hydrogen contained in the gaseous fraction 15 may be purified simultaneously with the treatments of the gaseous fractions obtained from the separation of the effluents from the ebullated-bed hydroconversion step b) and fixed-bed hydrocracking step e). The hydrogen may be purified by washing with amines, by a membrane, by a PSA (Pressure Swing Adsorption) system, or by two or more of these means disposed in series.

In a preferred embodiment, the separation step f), in addition to the gas-liquid separation or the succession of separation devices, comprises at least one atmospheric distillation, in which the liquid hydrocarbon fraction(s) obtained after separation are fractionated by atmospheric distillation into at least one atmospheric distillate fraction 14, including compounds with a boiling point of less than 350° C., and optionally a liquid fraction comprising vacuum distillate, including compounds with a boiling point of greater than 350° C. At least some and preferably all of the atmospheric distillate fraction 14 and optionally of the fraction comprising vacuum distillate is advantageously sent to the steam cracking step g).

Optionally, at least some of the vacuum distillate fraction is recycled into the hydrocracking step e) and, according to this variant, it may be necessary to perform a purge consisting of unconverted vacuum distillate fractions, so as to deconcentrate the polyaromatic species and to limit the deactivation of the hydrocracking catalyst of step e). In order to limit the purge and thus increase the overall conversion, it may be advantageous to perform this purge, optionally, by sending at least part of the unconverted vacuum distillate fraction to the entry of the deasphalting step a), so as at least partly to remove the polyaromatic species in the asphalt-comprising fraction 4.

Very preferably, when the hydrocracking step e) is performed in maxi-naphtha mode, the compounds which boil at above 180° C. are at least partly and preferably entirely recycled to step e), in order to increase the yield of compounds boiling below 180° C. in the atmospheric distillate cut 14.

Steam Cracking Step g)

In accordance with the invention, the process comprises a step g) of steam cracking of the raffinate fraction 10 obtained from the extraction step d), of the fraction 8 obtained from the separation step c) and of the liquid fraction 14 obtained from the separation step f), comprising compounds with a boiling point of less than 350° C., and optionally a fraction comprising compounds with a boiling point of greater than 350° C., obtained from the separation step f).

The steam cracking step g) is advantageously performed in at least one pyrolysis furnace at a temperature of between 700 and 900° C., preferably between 750 and 850° C., and under a pressure of between 0.05 and 0.3 MPa relative. The residence time of the hydrocarbons is generally less than or equal to 1.0 second (noted as s), preferably between 0.1 and 0.5 s. Water vapour is advantageously introduced upstream of the steam cracking step g). The amount of water introduced is between 0.3 and 3.0 kg of water per kg of hydrocarbons at the entry to step g). Step g) is preferably performed in a plurality of parallel pyrolysis furnaces, so as to adapt the operating conditions to the various streams supplying the step g) and obtained from steps c), d), f) and h), and also to manage the tube decoking times. A furnace comprises one or more tubes disposed in parallel. A furnace may also denote a group of furnaces operating in parallel. For example, one furnace may be dedicated to the cracking of ethane-rich fractions, another furnace dedicated to propane-rich and butane-rich cuts, another furnace dedicated to cuts comprising compounds with a boiling point of between 80 and 180° C., and another furnace dedicated to cuts comprising compounds with a boiling point of between 180 and 350° C.

Step h) of Separation of the Steam Cracking Effluent

The process preferably comprises a step h) of separating the effluent 16 obtained from the steam cracking step g), enabling the production of at least one fraction 17 comprising, preferably consisting of, hydrogen, a fraction 18 comprising, preferably consisting of, ethylene, a fraction 19 comprising, preferably consisting of, propylene, and a fraction 20 comprising, preferably consisting of, pyrolysis oil. Optionally, the separation step h) enables recovery also of a fraction comprising, preferably consisting of, butenes and a fraction comprising, preferably consisting of, pyrolysis gasoline.

The cuts rich in saturated compounds obtained from the light gases or from the pyrolysis gasoline obtained from the separation step h) may preferably be recycled into the steam cracking step g), notably ethane and propane, so as to increase the yield of ethylene and propylene.

The pyrolysis oil fraction 20 may optionally be subjected to an additional step of separation so as to produce a number of fractions, for example a light pyrolysis oil comprising compounds with a boiling point of less than 350° C. and a heavy pyrolysis oil comprising compounds with a boiling point of greater than 350° C. The light pyrolysis oil may advantageously be injected upstream of the hydrocracking step d). The heavy pyrolysis oil may advantageously be injected upstream of the hydroconversion step b) and/or of the deasphalting step a). Advantageously, the separation of the fraction 20 into two fractions and the recycling of those fractions into one of steps b), a) or e) of the process allows the formation of olefins from heavy hydrocarbon feedstocks to be maximized.

EXAMPLE

The example below illustrates a particular implementation of the process according to the invention, without limiting the scope thereof.

The heavy hydrocarbon feedstock 1 treated in the process is a vacuum residue originating from the Urals and having the properties indicated in Table 1.

TABLE 1

| Feedstock properties | | |
|---|---|---|
| Sulfur content | % m/m | 2.66 |
| Mass per unit volume | kg/m$^3$ | 1,006 |
| C7 asphaltene content | % m/m | 3.9 |
| Ni + V content | ppm | 203 |
| Content of compounds boiling above 540° C. | % m/m | 82 |

Feedstock 1 is subjected to a deasphalting step a) which is performed in an extraction column operating continuously, under the conditions presented in Table 2.

TABLE 2

| Conditions of the deasphalting step | | |
|---|---|---|
| Nature of solvent | — | Propane |
| Content of solvent relative to the deasphalting feedstock | v/v | 8/1 |
| Temperature at top of extractor | ° C. | 80 |
| Temperature at bottom of extractor | ° C. | 60 |
| Pressure at top of extractor | MPa abs | 4.0 |

On conclusion of the deasphalting step a), a DAO fraction 3 is obtained with a yield of 39%, and an asphalt-comprising fraction 4 is obtained with a yield of 61%; these yields are based on the feedstock of the deasphalting step a).

The asphalt-comprising fraction 4 obtained from the deasphalting step a) is subjected to a hydroconversion step b) in two ebullated-bed reactors in series, and in the presence of an ebullated-bed hydroconversion catalyst in the form of NiMo on alumina, under the conditions indicated in Table 3.

TABLE 3

| Conditions of the ebullated-bed hydroconversion step a) | | |
|---|---|---|
| Temperature of reactors 1 and 2 | ° C. | 425 |
| Partial pressure of hydrogen | MPa abs | 16 |
| H2/HC (volume coverage of hydrogen relative to the feedstock volume) | Nm$^3$/m$^3$ | 1,000 |
| HSV of the reactors (volume flow rate of feedstock/volume of reactors) | h$^{-1}$ | 0.2 |

The effluent obtained from the ebullated-bed hydroconversion step b) is subjected to a separation step c) comprising separating drums and also an atmospheric distillation column and a vacuum distillation column. The yields of the various fractions obtained after separation are indicated in Table 4 (% by mass relative to the feedstock upstream of the ebullated-bed hydroconversion step b), noted as % m/m).

TABLE 4

| Yields of the hydroconversion step a) after separation in step b) | | |
|---|---|---|
| NH3 + H2S | % m/m | 2.93 |
| C1-C4 | % m/m | 3.7 |
| Fraction (PI-180° C.) | % m/m | 7.6 |
| Fraction (180-350° C.) | % m/m | 20.0 |
| Fraction (350-540° C.) | % m/m | 33.4 |
| Fraction (540° C.+) | % m/m | 32.4 |

The DAO fraction 3 obtained from the deasphalting step a), the fraction (180-350° C.) and the fraction (350-540° C.) obtained from the separation step c) are sent to an aromatics extraction step d), which is performed in a mixer-settler, the conditions of which are presented in Table 5.

TABLE 5

| Conditions of the extraction step d) | | |
|---|---|---|
| Nature of solvent | — | Furfural |
| Content of solvent relative to the extraction feedstock | v/v | 1.5/1 |
| Extraction temperature | ° C. | 110 |
| Extraction pressure | MPa abs | 0.5 |

TABLE 5-continued

| Conditions of the extraction step d) | | |
|---|---|---|
| Residence time in mixing zone | Minutes | 20 |
| Residence time in settling zone | Minutes | 40 |

On conclusion of the aromatics extraction step d), an aromatics-depleted raffinate fraction 10 is obtained with a yield of 54.2%, and an aromatics-enriched extract fraction 9 is obtained with a yield of 45.8%; these yields are based on the total feedstock introduced to the aromatics extraction step d).

The extract fraction 9 obtained from the aromatics extraction step d) is sent to a fixed-bed hydrocracking step e) performed under the conditions presented in Table 6.

TABLE 6

| Conditions of the fixed-bed hydrocracking step e) | | |
|---|---|---|
| Hydrotreating temperature | ° C. | 380 |
| Hydrocracking temperature | ° C. | 382 |
| Partial pressure of hydrogen | MPa abs | 16 |
| H2/HC (volume coverage of hydrogen relative to the feedstock volume) | $Nm^3/m^3$ | 1,000 |
| HSV hydrotreating catalyst | $h^{-1}$ | 0.85 |
| HSV hydrocracking catalyst | $h^{-1}$ | 0.90 |
| Hydrotreating catalyst | NiMo on alumina | |
| Hydrocracking catalyst | NiW on alumina + zeolite | |

The effluent 13 obtained from the fixed-bed hydrocracking step e) is subjected to a separation step f) comprising separating drums and also an atmospheric distillation column. The yields of the various fractions obtained after separation are indicated in Table 7 (% by mass relative to the feedstock upstream of the fixed-bed hydrocracking step, noted as % m/m).

TABLE 7

| Yields of the fixed-bed hydrocracking step e) after separation in step f) | | |
|---|---|---|
| NH3 + H2S | % m/m | 0.9 |
| C1-C4 | % m/m | 4.8 |
| Fraction (PI-220° C.) | % m/m | 64.6 |
| Fraction (220-350° C.) | % m/m | 23.3 |
| Fraction (350° C.) | % m/m | 8.6 |

The liquid fractions (PI-220° C.), (220-350° C.) and (350° C.+) obtained from the step f) of separating the effluent from the fixed-bed hydrocracking step, the fraction 8 (PI-180° C.) obtained from the separation step c), and the raffinate fraction 10 obtained from the aromatics extraction step d) are sent to a steam cracking step g), in which each of the liquid fractions is cracked under different conditions (Table 8).

TABLE 8

| Conditions of the steam cracking step | | |
|---|---|---|
| Pressure at furnace exit | MPa abs | 0.2 |
| Temperature at furnace exit, fractions PI-220° C. and PI-180° C. | ° C. | 800 |
| Temperature at furnace exit, fraction 220-350° C. | ° C. | 790 |
| Temperature at furnace exit, fractions 350° C.+ and raffinate | ° C. | 780 |
| Ratio of steam to fractions PI-220° C. and PI-180° C. | kg/kg | 0.6 |

TABLE 8-continued

| Conditions of the steam cracking step | | |
|---|---|---|
| Ratio of steam to fraction 220-350° C. | kg/kg | 0.8 |
| Ratio of steam to fractions 350° C.+ and raffinate | kg/kg | 1.0 |
| Furnace residence time, fractions PI-220° C. and PI-180° C. | s | 0.3 |
| Furnace residence time, fraction 220-350° C. | s | 0.3 |
| Furnace residence time, fractions 350° C.+ and raffinate | s | 0.3 |

The effluents from the various steam cracking furnaces are subjected to a separation step h) which enables recycling of the saturated compounds and attainment of the yields presented in Table 9 (% by mass relative to the total feedstock upstream of the steam cracking step g), noted as % m/m).

TABLE 9

| Yields of the steam cracking step | | |
|---|---|---|
| H2, CO, C1 | % m/m | 7.8 |
| Ethylene | % m/m | 33.6 |
| Propylene | % m/m | 18.3 |
| C4 cut | % m/m | 14.6 |
| Pyrolysis gasoline | % m/m | 19.9 |
| Pyrolysis oil | % m/m | 5.9 |

Table 9 presents the yields of steam cracking products. Relative to the vacuum residue feedstock introduced into the deasphalting step a), the process according to the invention enables mass yields of ethylene and of propylene of 27.7% and 15.1%, respectively, to be achieved. Moreover, the specific sequence of steps upstream of the steam cracking step enables the limitation of coking.

The vacuum residue fraction (540° C.+) obtained from the step c) of separating the effluent from the ebullated-bed hydroconversion step b) and the pyrolysis oil fraction obtained from the step h) of separating the effluent from the steam cracking step g) are exploited commercially as fuel bases in order to make up—with other bases obtained from other processes—a heavy fuel oil.

The invention claimed is:

1. A process for producing olefins from a hydrocarbon feedstock (1) with a sulfur content of at least 0.1 weight %, an initial boiling point of at least 180° C. and a final boiling point of at least 600° C., said process comprising the following steps:

a) a deasphalting step a) by extraction of said heavy hydrocarbon feedstock (1) using a solvent (2) or a mixture of solvents, enabling the production of an asphalt-comprising fraction (4) and of a deasphalted oil fraction (3), b) a step b) of hydroconversion performed in an ebullated-bed reactor, in which the asphalt fraction (4) is contacted, in the presence of hydrogen, with a hydroconversion catalyst, said step enabling the production of an effluent (5), c) a step c) of separation of the effluent (5) obtained from the hydroconversion step b) into a gaseous fraction (6), a fraction (7) comprising compounds with a boiling point of between 180 and 540° C., and a fraction (8) comprising compounds with a boiling point of less than 180° C., d) a step d) of extraction of the aromatics from at least part of the deasphalted oil fraction (3) obtained from the deasphalting step a), and from at least part of the fraction (7) obtained from the separation step c), using a polar solvent (11), enabling the production of an extract fraction (9) and of a raffinate fraction (10), e) a step e) of fixed-bed hydrocracking of at least part of the extract fraction (9) obtained from the extraction step d) in the presence of hydrogen (12) and of a hydrocracking catalyst, enabling the production of an effluent (13), f) a step f) of separation of the effluent (13) obtained from the fixed-bed hydrocracking step e) into at least one gaseous fraction (15) and at least one liquid fraction (14) comprising compounds with a boiling point of less than or equal to 350° C., g) a step g) of steam cracking of the raffinate fraction (10) obtained from the extraction step d), of the fraction (8) obtained from the separation step c) and of the liquid fraction (14) obtained from the separation step f), enabling the production of an effluent (16), h) a step h) of separation of the effluent (16) obtained from the steam cracking step g), enabling the production of at least one hydrogen-comprising fraction (17), of an ethylene-comprising fraction (18), of a propylene-comprising fraction (19) and of a fraction (20) comprising pyrolysis oil.

2. The process according to claim 1, in which the deasphalting step a) is performed under conditions enabling the production of the deasphalted oil fraction (3) with a low asphaltene content, and of the asphalt-comprising fraction (4), which has a softening point of less than 120° C.

3. The process according to claim 1, in which the solvent (2) used in step a) is an apolar solvent containing at least 80% by volume of saturated hydrocarbon(s) comprising a carbon number of between 3 and 5.

4. The process according to claim 1, in which the separation step c) comprises a vacuum distillation enabling the production of at least one vacuum distillate fraction and of at least one vacuum residue fraction, wherein at least part of the at least one vacuum distillate fraction contains at least part of the fraction (7).

5. The process according to claim 4, in which the separation step c) comprises, upstream of the vacuum distillation, an atmospheric distillation enabling the production of at least one atmospheric distillate fraction and at least one atmospheric residue fraction, said atmospheric residue fraction being sent into said vacuum distillation, enabling the production of the at least one vacuum distillate fraction and of the at least one vacuum residue fraction.

6. The process according to claim 1, in which the polar solvent employed in the aromatics extraction step d) is selected from furfural, N-methyl-2-pyrrolidone (NMP), sulfolane, dimethylformamide (DMF), dimethyl sulfoxide (DMSO) and phenol, or is a mixture of at least some of these solvents.

7. The process according to claim 1, in which the hydrocracking step e) is implemented at a temperature of between 340 and 480° C. and at an absolute pressure of between 5 and 25 MPa.

8. The process according to claim 1, in which the hydrocracking step e) is performed so as to produce a yield of liquid compounds with a boiling point of less than 180° C. of more than 50 weight % of the feedstock entering the hydrocracking step e).

9. The process according to claim 1, in which the separation step f) comprises at least one atmospheric distillation enabling the production of at least one liquid fraction (14) comprising compounds with a boiling point of less than 350° C. and a liquid fraction comprising vacuum distillate comprising compounds with a boiling point of greater than 350° C.

10. The process according to claim 9, in which the liquid fraction (14) and the fraction comprising vacuum distillate are sent to the steam cracking step g).

11. The process according to claim 1, in which part of a fraction (8) comprising compounds with a boiling point of less than 180° C., obtained from the separation step c), is introduced into the steam cracking step g).

12. The process according to claim 1, in which the steam cracking step g) is performed in at least one pyrolysis furnace at a temperature of between 700 and 900° C., under a pressure of between 0.05 and 0.3 MPa, for a residence time of less than or equal to 1.0 second.

13. The process according to claim 1, in which the cuts rich in saturated compounds which are obtained from the light gases or from a pyrolysis gasoline obtained from the separation step h) are recycled into the steam cracking step g).

14. The process according to claim 1, in which the pyrolysis oil fraction (20) is subjected to an additional separation step so as to produce a light pyrolysis oil, comprising compounds with a boiling point of less than 350° C., and a heavy pyrolysis oil, comprising compounds with a boiling point of greater than 350° C., said light pyrolysis oil is injected upstream of the hydrocracking step e), and said heavy pyrolysis oil is injected upstream of the hydroconversion step b) and/or of the deasphalting step a).

* * * * *